US006583545B1

(12) United States Patent
Ide et al.

(10) Patent No.: US 6,583,545 B1
(45) Date of Patent: Jun. 24, 2003

(54) APERTURE GRILL MATERIAL FOR COLOR PICTURE TUBE, PRODUCTION METHOD THEREOF, APERTURE GRILL AND PICTURE TUBE

(75) Inventors: Tsuneyuki Ide, Ymaguchi-ken (JP); Hironao Okayama, Ymaguchi-ken (JP); Susumu Sigemasa, Ymaguchi-ken (JP); Yasuo Tahara, Ymaguchi-ken (JP)

(73) Assignee: Toyo Kohan., Ltd., Tokyo (JP)

( * ) Notice: Subject to any disclaimer, the term of this patent is extended or adjusted under 35 U.S.C. 154(b) by 0 days.

(21) Appl. No.: 09/763,599

(22) PCT Filed: Aug. 21, 1999

(86) PCT No.: PCT/JP99/04707

§ 371 (c)(1),
(2), (4) Date: Jun. 5, 2001

(87) PCT Pub. No.: WO00/12772

PCT Pub. Date: Mar. 9, 2000

(30) Foreign Application Priority Data

Sep. 1, 1998 (JP) ..... 10-261038

(51) Int. Cl.[7] ..... H01J 29/80; H01J 9/12

(52) U.S. Cl. ..... 313/402; 445/47; 445/36; 445/37; 313/403

(58) Field of Search ..... 313/402–408, 313/479, 490; 445/35–37, 46, 47; 252/521.2, 521.3, 521.5

(56) References Cited

U.S. PATENT DOCUMENTS

| | | | | | |
|---|---|---|---|---|---|
| 5,488,263 | A | * | 1/1996 | Takemura et al. | 313/402 |
| 5,871,851 | A | * | 2/1999 | Fukumizu et al. | 428/667 |
| 6,420,054 | B1 | * | 7/2002 | Cozar et al. | 428/682 |
| 6,447,716 | B1 | * | 9/2002 | Cozar et al. | 420/445 |
| 2002/0070653 | A1 | * | 6/2002 | Kodama et al. | 313/402 |

FOREIGN PATENT DOCUMENTS

| | | | | | |
|---|---|---|---|---|---|
| JP | 05148583 | A | * | 6/1993 | C22C/38/00 |
| JP | 05311327 | A | * | 11/1993 | C22C/38/00 |
| JP | 05311331 | A | * | 11/1993 | C22C/38/00 |
| JP | 08067945 | A | * | 3/1996 | C22C/38/00 |
| JP | 10158788 | A | * | 6/1998 | C22C/38/00 |
| JP | 10219396 | A | * | 8/1998 | C22C/38/00 |
| SU | 1435652 | A1 | * | 11/1987 | |

OTHER PUBLICATIONS

DialogIP Document, English language Abstract of JP 08–067945 A, published Mar. 12, 1996 to Nisshin Steel Co., Ltd.

DialogIP Document, English language Abstract of JP 10–158789, published Jun. 16, 1998 to Nisshin Steel Co., Ltd.

* cited by examiner

*Primary Examiner*—Ashok Patel
*Assistant Examiner*—German Colón
(74) *Attorney, Agent, or Firm*—Browdy and Neimark, P.L.L.C.

(57) ABSTRACT

A purpose of the present invention is to provide material of an aperture grille used for a color picture tube having excellent yield strength, excellent high temperature creep strength and excellent magnetic characteristic, material of an aperture grille used for a color picture tube for improving an occurrence of cracking during a hot rolling step, a method for producing these material, an aperture grille and a color picture tube with the aperture grille. After adding nickel of 0.01 to 1.75 wt % to low carbon alloy steel including copper of 0.05 to 2.5 wt % and phosphor of 0.001 to 0.4 wt %, material according to the present invention is cold rolled. Then, a precipitation treatment is processed at a temperature of 300 to 700° C. Alternatively, the material is cold rolled and secondary rolled after passing through an intermediate annealing at a temperature of 500 to 800° C. Then, the precipitation treatment is processed.

8 Claims, No Drawings

APERTURE GRILL MATERIAL FOR COLOR PICTURE TUBE, PRODUCTION METHOD THEREOF, APERTURE GRILL AND PICTURE TUBE

INDUSTRIAL FIELD

The present invention relates to a material for an aperture grille for use in a color picture tube, a production method therefor, an aperture grille and a color picture tube installed incorporating the aperture grille.

The present invention particularly relates to a material for an aperture grille material for use in a color picture tube having excellent tensile strength, excellent high temperature creep strength and excellent magnetic characteristic, a method for producing the color picture tube, an aperture grille made thereof, and a color picture tube incorporating this aperture grille.

BACKGROUND OF THE INVENTION

It has been required for material of an aperture grille used for a color picture tube to have tensile strength of at least 60 kgf/mm$^2$, since the aperture grille is welded on a frame under loading large amount of tensile strength during a step of producing the aperture grille. Regarding material of an aperture grille presently used for a color picture image, a low carbon steel sheet which is hard-treated has been employed.

In a conventional art, an aperture grille is thermally treated so as to become a black aperture grille after the aperture welded on a frame. In such a case, the above thermal treatment is operated at 455° C. less than a recrystallization temperature of steel sheet for a short time, i.e. 15 minutes so as to maintain a condition in which each a tape constituting a black aperture grille is not loosed and its tensile force keeps on being loaded.

However, in the case that a thermal treatment for blackening is operated under the above condition, it can not be avoid for occurring a recovery phenomenon of the steel. The tape is extended by recovering the steel. The phenomenon causes a reason why the tape is twisted or broken. Regarding material of an aperture grille for a color picture tube, it is required material having tensile strength equal or more than 60 kgf/mm$^2$ and creep strength equal or less than 0.4% while a thermal treatment for blackening is operated at 455° C. for 15 minutes.

A color picture tube comprises an electron gun and a luminescent screen for converting electron beams to an picture image. In order to avoid earth magnetism for deflecting the electron beam, it is necessary for an inside portion of the color picture tube to have a characteristic as magnetic shield material. Therefore, it is required material having large magnetic flux density (Br), small coercive force (Hc) and a high ratio (Br/Hc) of the magnetic flux density with respect to the coercive force.

However, regarding a low carbon steel sheet for which a strength process and a thermal treatment for blackening are processed so as to obtain a high yield strength described above, the magnetic flux density is relatively small, that is, not more than 8 KG and the coercive force is relatively large, that is, about 5 oersted (Oe). Accordingly the ratio of Br/Hc is relatively small, that is, about 1.6. Such an amount is insufficient as magnetic shield material.

In a conventional art, regarding a method for improving a tensile yield strength of a low carbon steel sheet, there is a solid solution strengthen method affected by carbon and nitrogen. However, if amounts of carbon and nitrogen in the steel is increased, carbide and nitride are increased. Thereby, it is apt to be prevented magnetic domain walls from moving so that magnetic characteristics are deteriorated. Although there is a method for precipitating carbide or others in a steel sheet as a method for improving a creep strength, a diameter of almost grains of the precipitates is large and belonged in a size of micron order and a movement of the magnetic domain walls is prevented so that the magnetic characteristic is largely deteriorated. Such a method is not applied to a present method for producing material of an aperture grille used for a color picture tube.

To resolve the technical drawbacks described above, the inventors have already recommended precipitation-strength type low alloy steel with copper and phosphor. The steel with additive of copper and phosphor is material having high strength and high magnetic characteristic. The technical concepts thereof will be disclosed hereinafter.

In the case of adding copper in an extremely low carbon steel, a micro copper phase ($\epsilon$ phase) having a size of nano meter (nm) is precipitated by an precipitation treatment. In the case of adding phosphor, solid solution strength thereof is affected by adding phosphor is utilized so that tensile strength of the material can be equal or more than 60 kg/mm$^2$ and the material can have excellent magnetic characteristics having the ratio Br(KG)/Hc(Oe) equal or more than 2.5 when the steel is heated by the precipitation process.

A steel sheet with additive of copper and/or phosphor is high quality material of an aperture grille for a color picture tube as described above. However, it is recognized that hot roll cracking phenomenon is occurred during a hot rolling step in a method for producing the material. As the result, the yield for producing a steel sheet is rarely reduced.

A purpose of the present invention is to provide material of an aperture grille used for a color picture tube having excellent tensile strength and excellent high temperature creep characteristic, wherein various characteristics of a steel sheet with additive of copper and phosphor can be maintained and a high yield level can be maintained.

DISCLOSURE OF THE INVENTION

An invention recited in claim 1 relates to material of an aperture grille used for a color picture tube comprising copper of 0.05 to 2.5 wt %, wherein the material is characterized of further including nickel of 0.01 to 1.75 wt %.

An invention recited in claim 2 relates to material of an aperture grille used for a color picture tube comprising copper of 0.05 to 2.5 wt % and phosphor of 0.001 to 0.4 wt %, wherein the material is characterized of further including nickel of 0.01 to 1.75 wt %.

An invention recited in claim 3 relates to a method for producing material of an aperture grille used for a color picture tube, wherein said method is characterized of comprising a step of a precipitation treatment in a temperature range of 300 to 700° C. after cold rolling a low carbon alloy hot rolled steel including copper of 0.05 to 2.5 wt % and nickel of 0.01 to 1.75 wt %.

An invention recited in claim 4 relates to a method for producing material of an aperture grille used for a color picture tube, wherein said method is characterized of comprising a step of a precipitation treatment in a temperature range of 300 to 700° C. after cold rolling a low carbon alloy hot rolled steel including copper of 0.05 to 2.5 wt %, nickel of 0.01 to 1.75 wt % and phosphor of 0.001 to 0.4 wt %.

An invention recited in claim 5 relates to a method for producing material of an aperture grille used for a color picture tube, wherein said method is characterized of comprising a step of cold rolling low carbon alloy hot rolled steel including copper of 0.05 to 2.5 wt % and nickel of 0.01 to 1.75 wt %, a step of secondary cold rolling after intermediate annealing in a temperature range of 500° C. to 800° C., and a step of a precipitation treatment in a temperature range of 300 to 700° C.

An invention recited in claim 6 relates to a method for producing material of an aperture grille used for a color picture tube, wherein said method is characterized of comprising a step of cold rolling low carbon alloy hot rolled steel including copper of 0.05 to 2.5 wt %, nickel of 0.01 to 1.75 wt % and phosphor of 0.001 to 0.4 wt %, a step of secondary cold rolling after intermediate annealing in a temperature range of 500° C. to 800° C., and a step of an elution treatment in a temperature range of 300 to 700° C.

An invention recited in claim 7 relates to an aperture grille used for a color picture tube made of a low carbon alloy steel sheet including copper of 0.05 to 2.5 wt % and nickel of 0.01 to 1.75 wt %.

An invention recited in claim 8 relates to an aperture grille used for a color picture tube made of a low carbon alloy steel sheet including copper of 0.05 to 2.5 wt %, nickel of 0.01 to 1.75 wt % and phosphor of 0.001 to 0.4 wt %.

An invention recited in claim 9 relates to a color picture tube with an aperture grille made of a low carbon alloy steel sheet including copper of 0.05 to 2.5 wt % and nickel of 0.01 to 1.75 wt %.

An invention recited in claim 10 relates to a color picture tube with an aperture grille made of a low carbon alloy steel sheet including copper of 0.05 to 2.5 wt %, nickel of 0.01 to 1.7 5 wt % and phosphor of 0.001 to 0.4 wt %.

BEST MODE FOR CARRYING OUT THE INVENTION

In the present invention, a copper phase (ϵ-copper phase) of which a grain diameter is very fine such as a size of nano-meter (nm) can be precipitated in an extreme low carbon steel sheet with additive of copper.

Further, by utilizing a solid solution hardening method by adding phosphor, the tensile strength of the material can be maintained a level equal or more than 60 kgf/mm$^2$ and excellent magnetic characteristic having the ratio of Br(KG)/Hc(Oe) equal or more than 2.5 can be obtained by a thermal treatment through the precipitation process.

In the present invention, hot cracking phenomenon which is usually occurred at a manufacturing process can be prevented by adding nickel into the material. The present invention will be explained in detail hereinafter.

As the extreme low carbon steel sheet for material of an aperture grille used for a color picture tube according to the present invention, it is preferable that a steel sheet is decarbonized and denitrified by a vacuum degasification method so as to decrease carbide and nitride in the steel sheet and the growth of crystal grain is promoted in a hot rolling step or a continues annealing step. Further, it is necessary to provide a limitation and reduce carbon atoms and nitrogen atoms in steel as less as possible since carbide and nitride finely dispersed in the steel. In such a steel sheet, magnetic domain walls are prevented from moving and the magnetic characteristic of the steel is deteriorated.

At first, it will described about atoms added to steel for material of an aperture grille used for a color picture tube according to the present invention and the limitation of the added atoms.

If an amount of carbon is large in a steel sheet after cold rolling, an amount of carbide is increased and the movement of magnetic domain walls and growth of crystal grains are prevented. These become a reason why the magnetic characteristics are deteriorated. An upper limit amount of added carbon should be 0.01 wt %. A lower limit amount thereof is preferably as less as possible. The lower limit amount is actually depending on a performance of a vacuum degasification treatment.

Adding manganese is necessary to prevent the steel from hot-cracking by fixing manganese with sulfur as MnS. However, in view of improving the magnetic characteristic, the additive amount of manganese is preferably as less as possible. The additive amount is preferably equal or less than 0.5 wt %.

Silicone deteriorates an adhesive characteristic of a black film. The additive amount of silicone is preferably equal or less than 0.3 wt %.

In view of the growth of crystal grain, an amount of sulfur is as less as possible. The additive amount is preferably equal or less than 0.005 wt %. Regarding nitrogen, the additive amount is equal or less than 0.5 wt % in view of the growth of the crystal grain.

The more an additive amount of copper is increased, the more the precipitation amount of the ϵ-phase through a precipitation treatment is increased. The yield strength and the creep strength of the material are remarkably improved. A size of the ϵ-phase is belonged in nano-meter order. The ϵ-phase is fine precipitation. Different from precipitation having a size of micro meter order, magnetic domain walls can not be prevented almost and the magnetic characteristics are deteriorated a little. By increasing the additive amount of copper, the yield strength of the material and the creep strength can be improved without deteriorating the magnetic characteristic.

However, if the additive amount of copper is less than 0.05 wt %, the improvement of the yield strength and the creep strength of the material can not be obtained. On the other hand, if the additive amount of copper is to much, an amount of the precipitation becomes too large and the magnetic characteristic is deteriorated. The additive amount is preferably equal or less than 2.5 wt %.

Phosphor is effective to improve the strength of the material by utilizing a solid solution method. By adding phosphor, the tensile strength and the creep strength of the material can be largely improved. Accordingly, in addition to a precipitation treatment according to the present invention by adding copper, a solid solution hardening method caused by phosphor can be combined. If an additive amount of phosphor is equal or more than 0.001 wt %, the sufficient strength can be obtained. If the additive amount exceeds 0.4 wt %, mix gains caused by segregation would be occurred. The additive amount of phosphor is preferably equal or less than 0.4 wt %.

Nickel has an effect for avoiding a hot-cracking phenomenon caused by adding copper. Thereby, the yield in a step for producing material of an aperture grille according to the present invention can be improved largely. It is preferable to add nickel. Further, nickel has an effect for saving segregation of copper. The quality of the material can become stable. Nickel also has an effect for improving the tensile strength and the creep strength caused by a solid solution hardening method with nickel.

Further, nickel is solid soluble in iron so that the magnetic characteristics of the material can not be deteriorated.

An effect of nickel additive can be sufficiently obtained, if an amount of nickel is equal or less than 2/3 of the amount of copper. It is preferable that nickel additive is within a range from 0.01 wt % to 1.75 wt %. If the additive amount is too small, that is, less than 0.01 wt %, the effect can not be shown clearly. On the other hand, if the additive amount is more than 1.75 wt %, the effect is saturated. Accordingly, it is preferable that the additive amount of nickel is a half of the additive amount of copper. In the next, it will be explained a method for producing a thin steel sheet for material of an aperture grille used for a color picture tube according to the present invention.

After hot rolling, an extreme low carbon steel sheet produced by a vacuum dissolution method or a vacuum degasification method is acid cleaning so as to remove deoxidized film formed in a hot rolling step wherein the extreme low carbon steel sheet comprises the above described chemical components. Continuously, the steel sheet is cold rolled so as to have a thickness of 0.035 mm to 0.2 mm. Then, a precipitation treatment is operated at a temperature within a range from 300° C. to 700° C. for 10 minute to 20 hours. In the case that the additive amount of copper or copper with phosphor is too large, a temperature of recrystallization is increased so that the temperature for the precipitation treatment may be approached to 700° C., that is, the upper temperature level. In general, judging from the precipitation amount of copper and grain diameter of precipitated material, it is preferable to elute the material at a temperature within a range from 450° C. to 550° C. If the precipitation temperature is less than 300° C., the $\epsilon$-phase is precipitated insufficiently so that necessary tensile strength can not be obtained. On the other hand, if the precipitation temperature is higher than 700° C., the precipitated amount is too much. The $\epsilon$-phase is solid solved in a steel sheet so that the tensile strength of the material is reduced. Depending on a heating temperature and a heating time, the precipitation treatment may be operated in a box type annealing furnace or a continuous annealing furnace.

As a different embodiment, the above extreme low carbon steel sheet may be hot rolled, acid cleaned and cold rolled so as to have a thickness of 0.1 mm to 0.6 mm. Then, an intermediate annealing may be treated at a temperature within a range from 500° C. to 800° C. so as to control a diameter of crystal grain. The steel sheet may be secondary cold rolled so as to have a final thickness of 0.035 mm to 0.2 mm. The precipitation treatment may be operated. If an annealing temperature is less than 500° C., a softening effect is insufficient. If the precipitation treatment is operated after the secondary cold rolling, the tensile strength becomes remarkably high. On the other hand, in the case that the annealing temperature exceeds 800° C., a preferable tensile strength can not be obtained even if the above precipitation treatment is processed after the secondary cold rolling.

EXAMPLES

Embodiments according to the present invention will be explained.

Table 1 shows 14 kinds of steel sheets (A~N) comprising different composition each other, their chemical composition and ratios of cracking occurred in a step of hot rolling with respect to the respective steel sheet wherein each steel sheet is produced by hot rolling slab vacuum degasificated so as to have a thickness of 2.5 mm after hot rolling. These hot rolled sheets are acid cleaned with sulphuric acid and then cold rolled so as to produce two kinds of cold rolled sheets having a thickness of 0.1 mm or 0.3 mm. Regarding a cold rolled steel sheet having a thickness of 0.1 mm, the precipitation treatment is directly operated. Regarding a cold rolled steel sheet having a thickness of 0.3 mm, secondary cold rolling is operated so as to have a thickness of 0.1 mm through an intermediate annealing step. Then the precipitation treatment is operated.

The each material obtained by the above process is examined so as to measure its magnetic flux density and its coercive force by applying magnetic field of 10 oersted by a compact type Epstein magnetic measuring apparatus. Then, the ratio of Br(KG)/Hc(Oe) is detected.

The tensile strength is examined by use of TESILON and the creep strength is measured by a creep test machine (manufactured by TOKAI SEISAKUSHO). After applying stress of 30 kgf/mm$^2$ at 455° C. for 15 minutes in atmosphere, an extension ratio (%) is measured and evaluated.

Table 2 shows conditions of intermediate annealing and a precipitation treatment and characteristics with respect to a respective test material.

POSSIBILITY OF USE IN INVENTION

Material of an aperture grille recited in claim 1 is a low carbon steel sheet comprising copper of 0.05 to 2.5 wt % and nickel of 0.01 to 1.75 wt % and material of an aperture grille recited in claim 2 is a low carbon steel sheet comprising copper of 0.05 to 2.5 wt %, nickel of 0.01 to 1.75 wt % and phosphor of 0.001 to 0.4 wt %. These material have excellent magnetic characteristic and excellent strength.

A production method recited in claim 3 comprises a step of an elution treatment in a temperature range of 300 to 700° C. after cold rolling a low carbon alloy hot rolled steel including copper of 0.05 to 2.5 wt % and nickel of 0.01 to 1.75 wt %. A production method as claimed in claim 4 comprises a step of a precipitation treatment in a temperature range of 300 to 700° C. after cold rolling a low carbon alloy hot rolled steel including copper of 0.05 to 2.5 wt %, nickel of 0.01 to 1.75 wt % and phosphor of 0.001 to 0.4 wt %.

A production method as recited in claim 5 comprises a step of cold rolling low carbon alloy hot rolled steel including copper of 0.05 to 2.5 wt % and nickel of 0.01 to 1.75 wt %, a step of secondary cold rolling after intermediate annealing in a temperature range of 500° C. to 800° C., and a step of a precipitation treatment in a temperature range of 300 to 700° C.

A production method as recited in claim 6 comprises a step of cold rolling low carbon alloy hot rolled steel including copper of 0.05 to 2.5 wt %, nickel of 0.01 to 1.75 wt % and phosphor of 0.001 to 0.4 wt %, a step of secondary cold rolling after intermediate annealing in a temperature range of 500° C. to 800° C., and a step of a precipitation treatment in a temperature range of 300 to 700° C. In accordance with these production method, it can be obtained material of an aperture grille for a color picture tube having excellent tensile strength, excellent high creep strength and excellent magnetic characteristic.

In an aperture grille or a color picture tube as recited in claims 7 to 10, each tap constituting an aperture grille is not loosed even if the tape welded on a frame is thermal treated so as to blacken.

TABLE 1

Chemical composition of test material (steel sheet)

| Test material No. | Chemical composition (wt %) C | Mn | Si | S | N | Cu | P | Ni | Fe | Cracking ratio during hot rolling |
|---|---|---|---|---|---|---|---|---|---|---|
| A | 0.005 | 0.43 | 0.01 | 0.01 | 0.002 | 0.03 | 0.154 | 0.007 | remain | 0.0 |
| B | 0.004 | 0.45 | 0.01 | 0.01 | 0.002 | 0.05 | 0.0007 | 0.006 | remain | 3.5 |
| C | 0.006 | 0.46 | 0.01 | 0.01 | 0.002 | 0.05 | 0.150 | 0.007 | remain | 5.5 |
| D | 0.005 | 0.47 | 0.02 | 0.01 | 0.002 | 0.05 | 0.152 | 0.024 | remain | 0.0 |
| E | 0.007 | 0.45 | 0.01 | 0.01 | 0.002 | 1.61 | 0.0012 | 0.008 | remain | 10.5 |
| F | 0.004 | 0.44 | 0.01 | 0.01 | 0.002 | 1.55 | 0.159 | 0.781 | remain | 0.0 |
| G | 0.006 | 0.46 | 0.01 | 0.01 | 0.002 | 2.45 | 0.0006 | 0.008 | remain | 23.5 |
| H | 0.006 | 0.47 | 0.01 | 0.01 | 0.002 | 2.44 | 0.147 | 0.008 | remain | 22.5 |
| I | 0.005 | 0.46 | 0.01 | 0.01 | 0.002 | 2.44 | 0.155 | 1.250 | remain | 0.0 |
| J | 0.006 | 0.45 | 0.01 | 0.01 | 0.002 | 2.49 | 0.387 | 1.380 | remain | 0.0 |
| K | 0.007 | 0.44 | 0.01 | 0.01 | 0.002 | 2.49 | 0.358 | 1.800 | remain | 0.0 |
| L | 0.005 | 0.44 | 0.01 | 0.01 | 0.002 | 2.71 | 0.0008 | 0.007 | remain | 25.5 |
| M | 0.006 | 0.46 | 0.01 | 0.01 | 0.002 | 2.69 | 0.162 | 1.301 | remain | 0.0 |
| N | 0.005 | 0.44 | 0.01 | 0.01 | 0.002 | 2.69 | 0.415 | 1.301 | remain | 0.0 |

TABLE 2

Conditions of Intermediate Annealing and Precipitation Treatment and Characteristic of Test Material

| Test material No. | Intermediate annealing Temperature (° C.) | Time (min.) | Precipitation treatment Temperature (° C.) | Time (min.) | Br/Hc (kG/Oe) | Yield Strength (kgf/mm$^2$) | Creep extension (%) | Example or comparative example |
|---|---|---|---|---|---|---|---|---|
| A | — | — | 450 | 400 | 2.0 | 80 | 0.30 | Comparative example |
| B | — | — | 450 | 400 | 2.5 | 72 | 0.28 | Comparative example |
| C | — | — | 450 | 400 | 2.5 | 82 | 0.25 | Comparative example |
| D | — | — | 450 | 400 | 2.5 | 83 | 0.24 | Example |
| E | — | — | 450 | 400 | 2.6 | 75 | 0.05 | Comparative example |
| F1 | — | — | 250 | 1500 | 1.4 | 91 | 0.30 | Comparative example |
| F2 | — | — | 300 | 1200 | 2.5 | 85 | 0.28 | Example |
| F3 | — | — | 500 | 250 | 3.7 | 76 | 0.01 | Example |
| F4 | — | — | 700 | 10 | 4.3 | 67 | 0.05 | Example |
| F5 | — | — | 750 | 8 | 8.0 | 54 | 0.30 | Comparative example |
| G | — | — | 450 | 400 | 2.5 | 78 | 0.26 | Comparative example |
| H | — | — | 450 | 400 | 2.6 | 87 | 0.05 | Comparative example |
| I | 450 | 600 | 450 | 400 | 2.3 | 87 | 0.05 | Comparative example |
| I2 | 500 | 500 | 450 | 400 | 2.5 | 86 | 0.01 | Example |
| I3 | 650 | 150 | 450 | 400 | 2.6 | 85 | 0.01 | Example |
| I4 | 800 | 20 | 450 | 400 | 2.7 | 83 | 0.01 | Example |
| I5 | 850 | 10 | 450 | 400 | 2.0 | 90 | 0.01 | Comparative example |
| J | — | — | 450 | 400 | 2.5 | 92 | 0.01 | Example |
| K | — | — | 450 | 400 | 2.5 | 92 | 0.01 | Comparative example |
| L | — | — | 450 | 400 | 2.4 | 85 | 0.01 | Comparative example |
| M | — | — | 450 | 400 | 2.4 | 90 | 0.01 | Comparative example |
| N | — | — | 450 | 400 | 2.3 | 92 | 0.01 | Comparative example |

What is claimed is:

1. An aperture grill in a color picture tube consisting essentially of no more than 0.01 wt % carbon, 0.001–0.4 wt % phosphorus, 0.05–2.5 wt % copper, 0.01–1.75 wt % nickel, no more than 0.5 wt % manganese, no more than 0.3 wt % silicon, no more than 0.05 wt % sulfur, no more than 0.05 wt % nitrogen, with the remainder being substantially entirely Fe.

2. The aperture grill according to claim 1 wherein the amount of carbon is no more than about 0.006 wt %, the amount of manganese is no more than about 0.47 wt %, the amount of silica is no more than about 0.02 wt %, the amount of sulfur is no more than about 0.01 wt %, the amount of nitrogen is no more than about 0.002 wt %, the amount of phosphorous is at least 0.15 wt %, and the amount of nickel is about 0.024–1.38 wt %.

3. In a color picture tube comprising an aperture grill, the improvement wherein said aperture grill is the aperture grill of claim 1.

4. In a color picture tube comprising an aperture grill, the improvement wherein said aperture grill is the aperture grill of claim 2.

5. A method for producing an aperture grill for a color picture tube, comprising:

providing a low carbon alloy hot rolled steel consisting essentially of no more than 0.01 wt % carbon, 0.001–0.4 wt % phosphorus, 0.05–2.5 wt % copper, 0.01–1.75 wt % nickel, no more than 0.5 wt % manganese, no more than 0.3 wt % silicon, no more than 0.05 wt % sulfur, no more than 0.05 wt % nitrogen, with the remainder being substantially entirely Fe;

cold-rolling said low carbon alloy hot-rolled steel to provide a cold-rolled low carbon alloy steel; and subjecting said low carbon alloy cold-rolled steel to a precipitation treatment at a temperature of 300–700° C.

6. The method of claim 5 wherein said low carbon alloy steel consists essentially of:

an amount of carbon which is no more than about 0.006 wt %, an amount of manganese which is no more than about 0.47 wt %, an amount of silicon which is no more than about 0.02 wt %, an amount of sulfur which is no more than about 0.01 wt %, an amount of nitrogen which is no more than about 0.002 wt %, an amount of phosphorous which is at least 0.15 wt %, and an amount of nickel which is about 0.024–1.38 wt %.

7. A method for producing an aperture grill for a color picture tube, comprising:

providing a low carbon alloy hot rolled steel consisting essentially of no more than 0.01 wt % carbon, 0.001–0.4 wt % phosphorus, 0.05–2.5 wt % copper, 0.01–1.75 wt % nickel, no more than 0.5 wt % manganese, no more than 0.3 wt % silicon, no more than 0.05 wt % sulfur, no more than 0.05 wt % nitrogen, with the remainder being substantially entirely Fe;

cold-rolling said low carbon alloy hot-rolled steel to provide a cold-rolled low carbon alloy steel;

subjecting said cold-rolled low carbon alloy to annealing at a temperature of 500–800° C., followed by secondary cold-rolling; and subjecting said low carbon alloy cold-rolled steel to a precipitation treatment at a temperature of 300–700° C.

8. The method of claim 7 wherein said low carbon alloy steel consists essentially of:

an amount of carbon which is no more than about 0.006 wt %, an amount of manganese which is no more than about 0.47 wt %, an amount of silicon which is no more than about 0.02 wt %, an amount of sulfur which is no more than about 0.01 wt %, an amount of nitrogen which is no more than about 0.002 wt %, an amount of phosphorous which is at least 0.15 wt %, and an amount of nickel which is about 0.024–1.38 wt %.

* * * * *